US007448727B2

(12) United States Patent
Rai et al.

(10) Patent No.: US 7,448,727 B2
(45) Date of Patent: Nov. 11, 2008

(54) INK JET RECORDING HEAD AND INK JET RECORDING APPARATUS

(75) Inventors: Yoshihira Rai, Ebina (JP); Shinji Seto, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 301 days.

(21) Appl. No.: 11/049,204

(22) Filed: Feb. 2, 2005

(65) Prior Publication Data

US 2006/0066678 A1 Mar. 30, 2006

(30) Foreign Application Priority Data

Sep. 24, 2004 (JP) ..... 2004-278043

(51) Int. Cl.
*B41J 29/38* (2006.01)

(52) U.S. Cl. ..... 347/54; 347/40; 347/42; 347/68; 347/71; 347/206; 360/131; 360/134; 360/135; 400/56

(58) Field of Classification Search ..... 347/13, 347/42, 54, 68–72, 49
See application file for complete search history.

(56) References Cited

U.S. PATENT DOCUMENTS 4,357,614 A 11/1982 Tamai
4,698,643 A * 10/1987 Nishiguchi et al. ..... 347/206
6,779,871 B1 * 8/2004 Seto et al. ..... 347/40
6,783,207 B1 * 8/2004 Seto et al. ..... 347/40
2003/0122902 A1 * 7/2003 Sakaida et al. ..... 347/68
2004/0080568 A1 4/2004 Matsuo
2004/0109046 A1 * 6/2004 Taira ..... 347/68
2004/0189746 A1 * 9/2004 Kawashima ..... 347/37
2005/0001877 A1 * 1/2005 Chikanawa et al. ..... 347/42
2005/0041074 A1 * 2/2005 Watanabe et al. ..... 347/71

FOREIGN PATENT DOCUMENTS

JP 7-81049 3/1995
JP 10-095114 4/1998
JP 2002-067343 5/2002
JP 2003-226005 8/2003
JP 2004-209656 7/2004
WO 2004/056572 7/2004

* cited by examiner

*Primary Examiner*—Matthew Luu
*Assistant Examiner*—John P Zimmermann
(74) *Attorney, Agent, or Firm*—Fildes & Outland, P.C.

(57) ABSTRACT

The invention provides an ink jet recording head in which an element substrate provided in a head unit and constituted of plural drive elements is driven to discharge ink droplets from plural nozzles. In the ink jet recording head, the head unit has a substantially parallelogram shape, and plural head units are connected in a row to form a head bar.

22 Claims, 12 Drawing Sheets

INK JET RECORDING HEAD AND INK JET RECORDING APPARATUS

CROSS-REFERENCE TO RELATED APPLICATION

This application claims priority under 35 USC 119 from Japanese Patent Application No. 2004-278043, the disclosure of which is incorporated by reference herein.

BACKGROUND OF THE INVENTION

1. Field of the Invention

The present invention relates to an ink jet recording head and an ink jet recording apparatus for discharging ink droplets from plural nozzles by driving an element substrate such as a piezoelectric element.

2. Description of the Related Art

An ink jet recording apparatus for printing on a recording medium such as paper by discharging ink droplets from plural nozzles has various advantages such as compactness, inexpensiveness and quietness, and such ink jet recording apparatuses are widely available commercially.

Such ink jet recording apparatuses utilize a piezo ink jet method whereby, for example, pressurization from a piezoelectric element causes a pressure wave to act on an ink in a pressure chamber, thereby discharging an ink droplet from a nozzle.

In response to a requirement for high-speed printing, an ink jet recording apparatus capable of printing across the entire width of a recording medium without requiring a scanning motion of an ink jet recording head has recently been proposed.

As shown in FIG. 11, an ink jet recording head 200 is provided with a head bar 202 capable of printing across the entire width of a recording medium P. In the head bar 202, head units 204 each having plural nozzles 206 are arrayed in a mutually displaced arrangement (staggered arrangement) substantially parallel to a conveyance direction of the recording medium P. Each head unit 204 has four rows of nozzles 206 in the conveyance direction of the recording medium P, in order to achieve a high resolution. The ink jet recording head 200 can print across the entire width of the recording medium P by fixedly supporting the head bar 202 and conveying the recording medium P at a predetermined pitch in a direction indicated by an arrow as shown.

Further, an ink jet recording head 210 shown in FIG. 12 is provided with a head bar 212, in which head units 214, each having plural nozzles 216 in a staggered arrangement, are arranged mutually parallel, and obliquely to a conveyance direction of a recording medium P. Each head unit 214 has two rows of nozzles 216 and is therefore of a low resolution, but a high quality image can be obtained by arranging plural head units 214 obliquely without any gaps therebetween (see, for example, Japanese Patent Application Laid-Open (JP-A) No. 7-81049).

However, the ink jet recording head 200 shown in FIG. 11 involves wasted space because the head units 204 are arranged at a predetermined pitch in the longitudinal and transversal directions. Further, the head units 204 are increased in size in the width directions thereof (width in the conveyance direction of the recording medium P) in cases where the number of rows of the nozzles 206 is increased in order to achieve a higher resolution. Thus, the head bar 202 requires a width W at least equal to a product of the width of and the number of rows of the head units 204. As the width of the head bar 202 directly reflects on the width of the recording apparatus, the width of the head bar 202 has to be reduced in order to obtain a recording apparatus of overall compact size. Further, because printing conditions are adversely altered by the position of ink deposition in cases where the recording medium P is deformed during printing, a head bar 202 with a smaller width (namely printing area) is preferable. Further, at connecting portions of the head units 204, the nozzles used for printing an image are abruptly switched from the nozzles 206 of one head unit 204 to the nozzles 206 of another head unit 204, which is disadvantageous as this can generate streaks on printed images and because differences in characteristics between the head units 204 can become clearly evident.

In the ink jet recording head 210 shown in FIG. 12, since the head units 214 are arranged mutually parallel and in an oblique direction, a greater number of the head units 214 are required, leading to increased cost. Further, the oblique positioning of the head units 214 of rectangular shape increases a width W of the head bar 212, thus necessitating a larger size of the ink jet recording head 210. In addition, manufacture is difficult as plural head units 214 have to be precisely aligned.

On the other hand, an ink jet recording head in which head units of a trapezoidal shape, having a group of nozzles corresponding to such shape, are arrayed in an alternately inverted staggered arrangement has been proposed in order to reduce the width W of the head bar. In such an ink jet recording head, the head bar can be made with a smaller width in comparison with the ink jet recording heads 200, 210 shown in FIGS. 11 and 12, as the head units of the trapezoidal shape are arrayed in an alternately inverted staggered arrangement (see, for example JP-A No. 2003-226005, pages 5-6 and FIG. 4).

However, in this kind of ink jet recording head, in cases of irreparable nozzle clogging or damage to a discharge port, the entire head bar has to be replaced, since the head units are connected integrally. Further, since the head units have a trapezoidal shape, a wiping operation thereon in any direction geometrically causes contact with an adjacent head unit and thus maintenance cannot be carried out on the basis of individual head units.

SUMMARY OF THE INVENTION

The present invention has been made in consideration of the aforementioned circumstances, and is to provide a compact ink jet recording head and an ink jet recording apparatus, capable of printing an entire width of a recording medium with high quality, through an efficient arrangement of element substrates for driving head units. There are also provided an ink jet recording head and an ink jet recording apparatus allowing easy maintenance on the basis of individual head units.

A first aspect of the invention provides an ink jet recording head which discharges ink droplets by driving an element substrate provided in a head unit, the element substrate being constituted of plural drive elements, wherein the head unit has a substantially parallelogram shape, and a head bar is formed by connecting the plural head units in a row.

The element substrate mentioned above is constituted of a group of piezoelectric elements, each of which is driven to cause a pressure wave to act on an ink, thereby discharging an ink droplet from a nozzle. The substantially parallelogram shape means to include a parallelogram of which corners are cut off or rounded.

In the ink jet recording head of the first aspect, a head bar is formed by connecting plural head units in a row. In each head unit, by activation of the element substrate, ink droplets are discharged from nozzles onto a recording medium. In such ink jet recording head, since the head bar is constituted by connecting head units of a substantially parallelogram shape in a row, the head bar can be made smaller in the width thereof (width in a transporting direction of the recording medium), whereby the ink jet recording head can be made more compact. Also at the maintenance operation, a wiping operation or a sucking operation can be executed for each head unit.

A second aspect of the invention provides an ink jet recording apparatus, mounted with the ink jet recording head of the first aspect.

According to the second aspect, the ink jet recording apparatus can be made to be compact by employing the smaller ink jet recording head. Also it enables an easy maintenance on the basis of individual head units.

The present invention of the aforementioned configurations enables an efficient arrangement of the element substrates for driving the head units, thereby realizing an ink jet recording head and an ink jet recording apparatus of high quality and a small size. The invention also realizes easy maintenance on the basis of individual head units.

BRIEF DESCRIPTION OF THE DRAWINGS

Embodiments of the present invention will be described in detail based on the following figures, wherein.

DETAILED DESCRIPTION OF THE INVENTION

In the following, a first embodiment of the present invention will be described in detail, with reference to the accompanying drawings.

Figure 1:
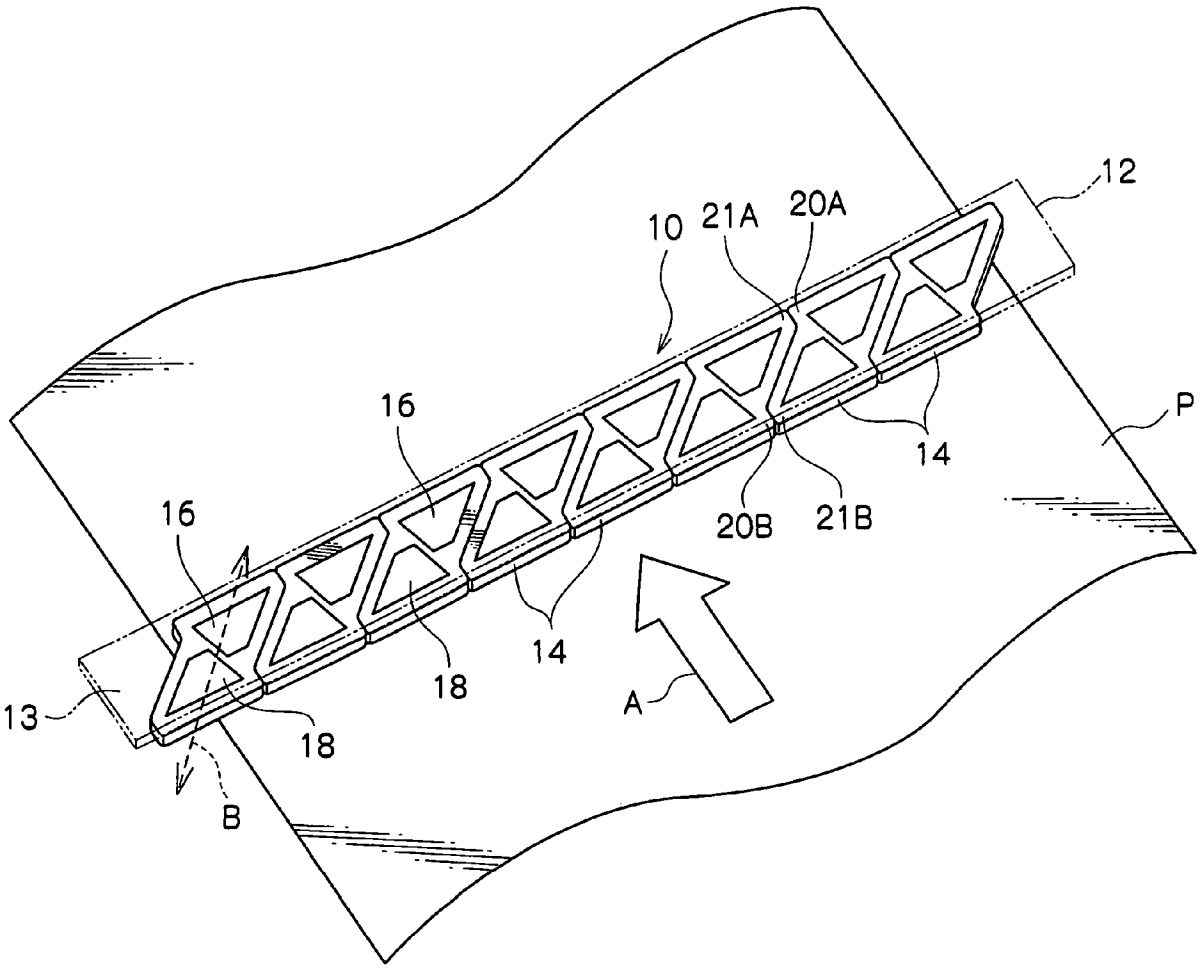
FIG. 1 is a perspective view showing an ink jet recording head of a first embodiment of the present invention.

FIG. 1 is a schematic perspective view showing an ink jet recording head 10 according to the first embodiment of the invention.

As shown in FIG. 1, the ink jet recording head 10 is mounted on an ink jet recording apparatus in which a recording medium P is transported along a direction A. The ink jet recording head 10 is equipped with a head bar 12 having a length corresponding to a maximum width of the recording medium P. The head bar 12 is fixedly supported, by an unillustrated support, in a position opposed to a transporting path of the recording medium P in the ink jet recording apparatus. The head bar 12 is provided, on a support member 13, with plural head units 14 connected in a row. Each head unit 14 is fixed to the support member 13 with screws (not shown) and is rendered individually replaceable. The recording medium P is transported with a predetermined pitch along a direction A shown in the illustration, thereby being printed by the head units 14 provided on the support member 13. Thus, the recording medium P can be printed over the entire width thereof by passing once under the head bar 12, without a scanning motion of the ink jet recording head 10.

Figure 2:
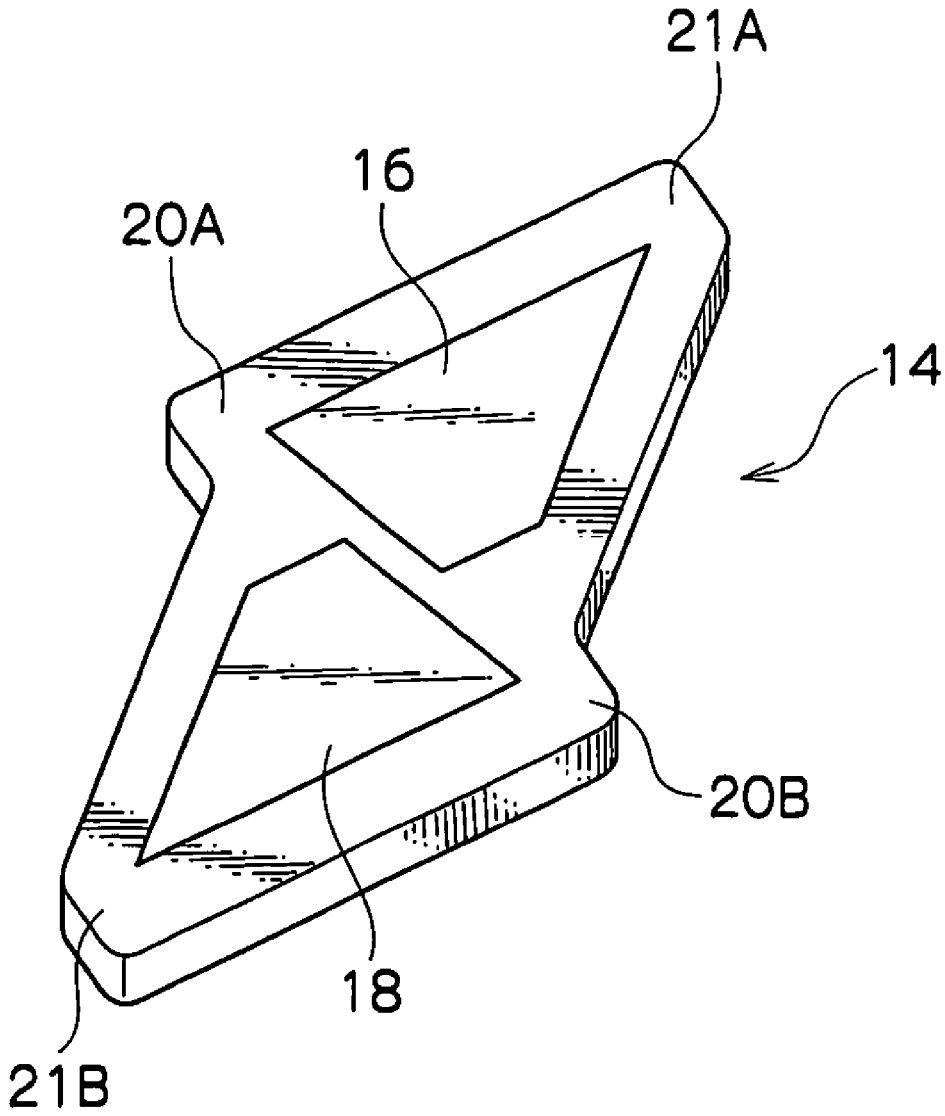
FIG. 2 is a perspective view showing an element substrate of a head unit constituting the ink jet recording head shown in FIG. 1.

As shown in FIG. 2, the head unit 14 has a substantially parallelogram shape, and two element substrates 16, 18 are provided on an upper surface of the head unit 14. The two element substrates 16, 18 have a substantially trapezoidal shape and are arranged, within the head unit 14, so that oblique sides of the same length (shorter oblique sides) in the substantially trapezoidal shape are mutually opposed. The element substrates 16, 18 are so shaped that an inner angle formed by the shorter oblique side is larger than an outer angle formed by the longer oblique side. More specifically, in the substantial trapezoid of the element substrate 16 and 18, an internal angle (called "inner angle") formed by an oblique side in the mutually opposed position and a corresponding bottom side is made larger than an internal angle (called "outer angle") formed by an oblique side other than the oblique side in the mutually opposed position and the corresponding bottom side. In the head unit 14, two obtuse angle portions of the substantial parallelogram are extended outwards to form extended portions 20A, 20B in order to maintain a predetermined width between an edge of the head unit 14 and the element substrates 16, 18. Also in the head unit 14, two acute angle portions of the substantial parallelogram are cut off to form corner cut portions 21A, 21B. When plural head units 14 are connected in a row, the extended portions 20A, 20B and the corner cut portions 21A, 21B are alternately opposed in adjacent positions as shown in FIG. 1.

Figure 3:
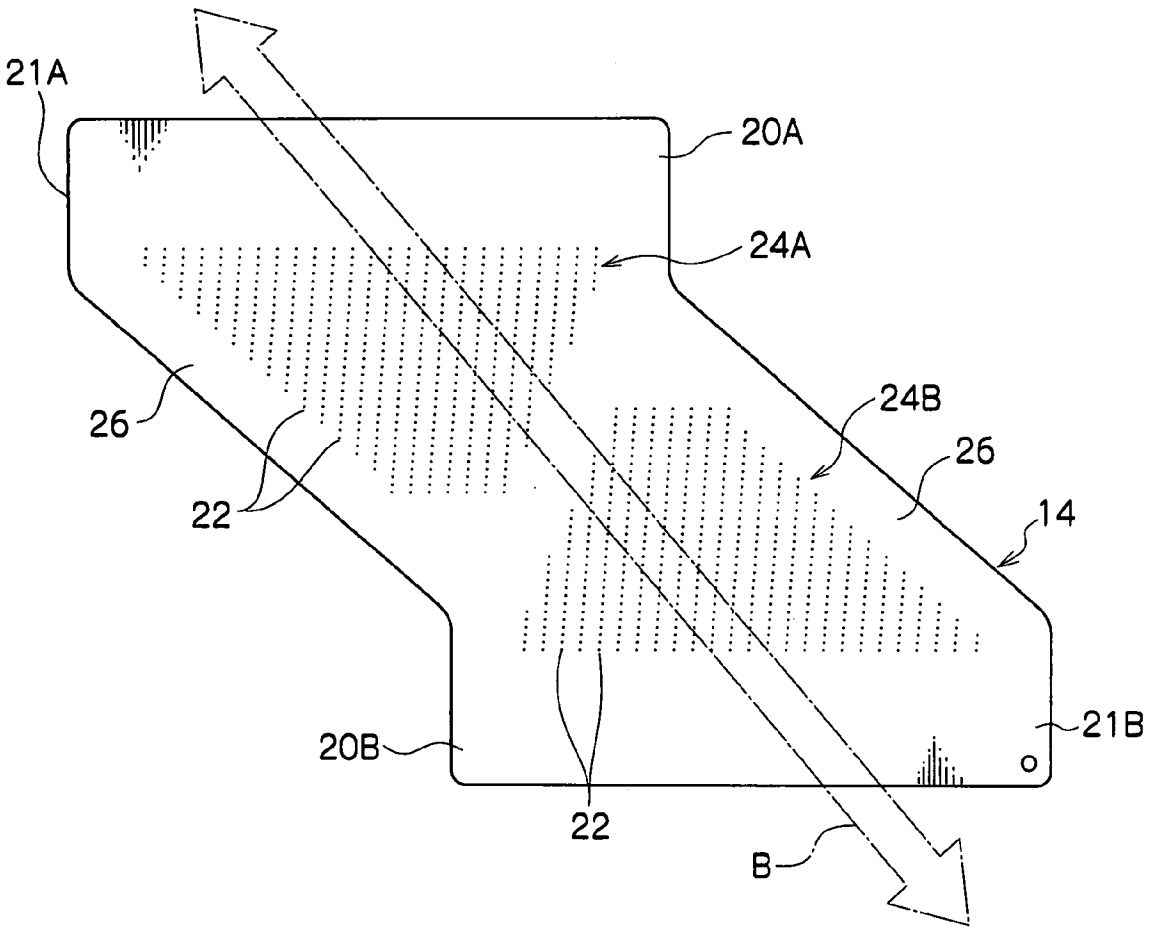
FIG. 3 is a plan view showing a nozzle area of the head unit constituting the ink jet recording head shown in FIG. 1.

As shown in FIG. 3, the head unit 14 is provided, at an opposite face thereof to the element substrates 16, 18, with nozzle areas 24A, 24B including plural nozzles 22. The element substrates 16, 18 are provided in positions corresponding to the two nozzle areas 24A, 24B, and, in a substantially trapezoidal area of the element substrate 16 or 18, there are provided a group of piezoelectric elements (not shown) for discharging ink droplets from the respective nozzles 22.

A wiper (not shown) for wiping the nozzles 22 at a maintenance operation is moved, as shown in FIGS. 1 and 3, along a direction indicated by an arrow B, namely in a direction from a bottom side to the other bottom side of the substantially trapezoidal shapes of the nozzle areas 24A, 24B. Thus the wiping operation can be executed on the basis of individual head units 14. Also the element substrates 16 and 18 of the adjacent head units 14 have a large overlapping amount when seen from the transporting direction of the recording medium P as shown in FIG. 1, so that the space between the nozzle areas 24A and the space between the nozzle areas 24B can be increased. Consequently, a capping margin 26 can be secured for a capping member (not shown) for covering the periphery of the nozzle areas 24A, 24B at maintenance operation (cf. FIG. 3). Thus a capping operation is made possible on the basis of individual head units 14.

Figure 4:
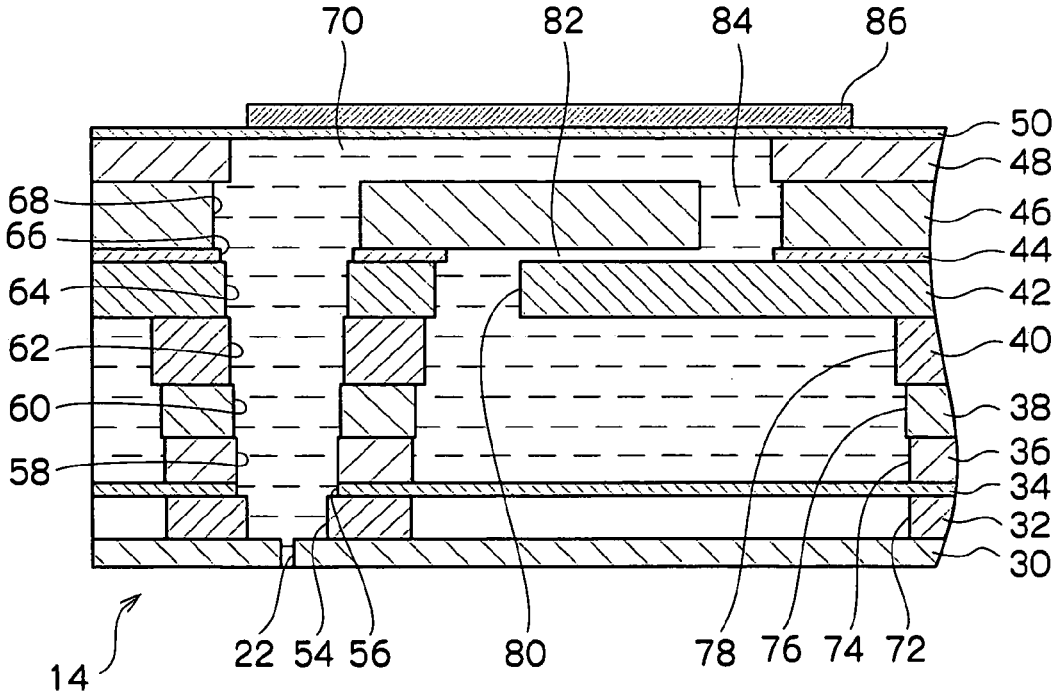
FIG. 4 is a partial cross-sectional view of the head unit of the ink jet recording head shown in FIG. 1.

As shown in FIG. 4, the head unit 14 is formed by laminating, on a nozzle plate 30, a communicating hole plate 32 and a damper member 34. On the damper member 34, there are laminated pool plates 36, 38, 40, a communicating hole plate 42, a flow path plate 44, a communicating hole plate 46, a pressure chamber plate 48 and a vibrating plate 50, which are mutually aligned and adjoined by adjoining means such as an adhesive.

The nozzle plate 30 is provided with a nozzle 22 for discharging an ink droplet. The communicating hole plate 32 is provided with a communicating hole 54 communicating with the nozzle 22, and the damper member 34 is provided with a communicating hole 56. The pool plates 36, 38, 40 are provided respectively with communicating holes 58, 60, 62, and the communicating hole plate 42 is provided with a communicating hole 64. Further, the flow path plate 44 is provided with a communicating hole 66, and the communicating hole plate 46 is provided with a communicating hole 68. The nozzle 22 and the communicating holes 54, 56, 58, 60, 62, 64, 66, 68 are in a mutually communicating relationship and is connected to a pressure chamber 70 formed in the pressure chamber plate 48.

On the other hand, the communicating hole plate 32 has a cavity 72 in a position under the damper member 34, thereby enabling a deformation of the damper member 34. The pool plates 36, 38, 40 are respectively provided with ink pools 74, 76, 78 which are mutually connected to constitute a single space. Such ink pools 74, 76, 78 store an ink, supplied from an unillustrated ink supply hole. Further, the communicating hole plate 42 is provided with a supply hole 80 so formed as to be connected with the ink pool 78, and the flow path plate 44 is provided with an ink flow path 82 communicating with the supply hole 80. Further, the communicating hole plate 46 is provided with a supply hole 84 which is so formed as to be connected with the ink flow path 82 at a side thereof opposite to the supply hole 80. These ink pools 74, 76, 78, the supply hole 80, the ink flow path 82, the supply hole 84 and the pressure chamber 70 are in a mutually communicating relationship, whereby the ink is supplied from the ink pools 74, 76, 78 into the pressure chamber 70.

Further, on the vibrating plate 50 and above the pressure chamber 70, there is mounted a piezoelectric element 86 as pressure generation means, which is given a driving voltage from an unillustrated flexible wiring board. The piezoelectric elements 86 are respectively provided above the pressure chambers 70 communicating with the individual nozzles 22, and piezoelectric element groups formed by the plural piezoelectric elements 86 constitute the element substrates 16, 18 shown in FIG. 1.

In the following, there will be explained the function of the above-described ink jet recording head 10.

In each head unit 14 of the ink jet recording head 10, an ink is supplied, as shown in FIG. 4, from the ink supply hole (not shown) to the ink pools 74, 76, 78. The ink stored in the ink pools 74, 76, 78 is filled into the pressure chamber 70 through the supply hole 80, the ink flow path 82 and the supply hole 84. When a drive voltage is applied to the piezoelectric element 86, the vibrating plate 50 is bent to deform together with the piezoelectric element 86, thereby expanding or compressing the pressure chamber 70. Thus a volume of the pressure chamber 70 changes, thereby generating a pressure wave therein. Under the effect of such pressure wave, the ink is moved through the communicating holes 54, 56, 58, 60, 62, 64, 66, 68 and an ink droplet is discharged from the nozzle 22 to the outside thereof. The pressure wave generated in the pressure chamber 70 propagates as a reflected wave in the ink pools 74, 76, 78 but such reflected wave is absorbed by the damper member 34.

In the ink jet recording head 10, as shown in FIG. 1, plural head units 14 are connected in a row on the head bar 12, and the head bar 12 is not moved at the printing operation. The recording medium P is moved at a predetermined pitch in the direction A, at a position opposed to the head bar 12, and ink droplets are discharged from the nozzles 22 of the head units 14, whereby an image is recorded over the entire width of the recording medium P.

In the ink jet recording head 10, as the plural head units 14 are mounted with screws (not shown) on the support member 13 of the head bar 12, each head unit 14 can be individually replaced. Further, as the head units 14 of a substantially parallelogram shape are arranged longitudinally in a row, a sucking operation or a wiping operation for the nozzles 22 can be executed for each head unit 14, thereby facilitating the maintenance operation.

The head unit 14 of the substantially parallelogram shape includes two element substrates 16, 18 of a substantially trapezoidal shape, so that the element substrates 16, 18 can be efficiently arranged within the head unit 14. It is therefore rendered possible to reduce the width (width in the transporting direction of the recording medium P) of the head unit 14, thereby realizing a compact ink jet recording head and also realizing a higher resolution.

Figure 5:
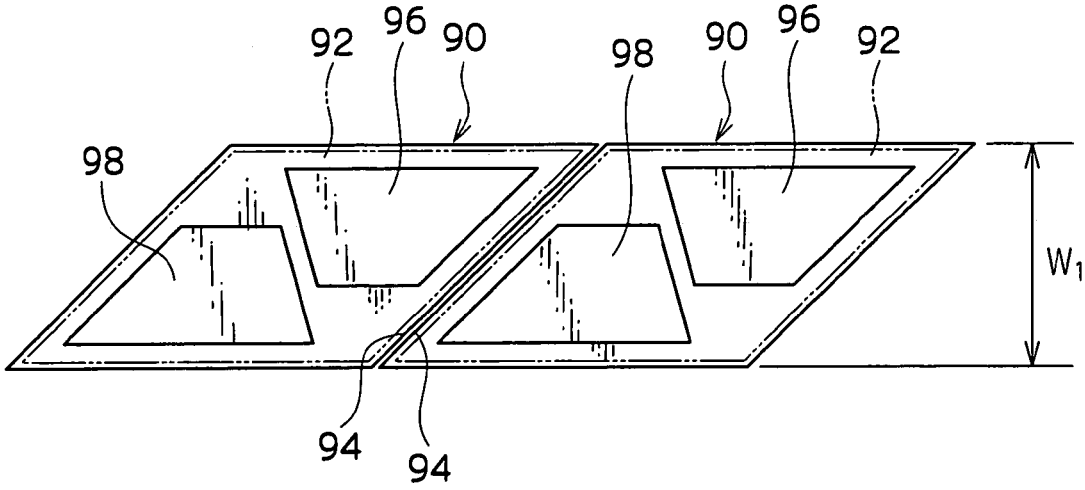
FIG. 5 is a plan view showing a head unit of a modification of the first embodiment of the invention.

FIG. 5 is a plan view showing a head unit 90 of a modification of the first embodiment of the invention.

As shown in FIG. 5, the head unit 90 has a substantially parallelogram shape, and plural head units 90 are connected in a row. The head unit 90 allows efficient positioning of two element substrates 96, 98 with shorter oblique sides of a substantially trapezoidal shape thereof in a mutually opposed position. Therefore, the head unit 90 can have a smaller width $W_1$ and can be compact in size. Also as the substantially trapezoidal shape of the element substrates 96, 98 has an outer angle smaller than an inner angle, the element substrates 96, 98 have a large overlapping amount when seen in the transporting direction of the recording medium P, whereby a large space can be secured between the element substrate 96 and the element substrate 98 in the adjacent head units 90. Such configuration allows to improve the productivity of the head unit 90, and also to secure a capping margin 92 around nozzle areas (not shown) at the opposite face of the element substrates 96, 98. In this manner it is rendered possible to execute maintenance (sucking or wiping) on the basis of individual head units 90. Also in cases of failure in a head unit 90, only the head unit can be removed, and thus replacement on the basis of individual head units 90 is possible. Furthermore, as a connecting portion 94 is formed long between the adjacent head units 90, a difference in the characteristics of the adjacent head units 90 does not clearly appear at such connecting portion 94 and such connecting portion 94 does not become noticeable on the image. More specifically, the nozzles used for printing are not abruptly switched to those of another head unit 90 so that a printed image does not show any streaks or the like.

Figure 6A:
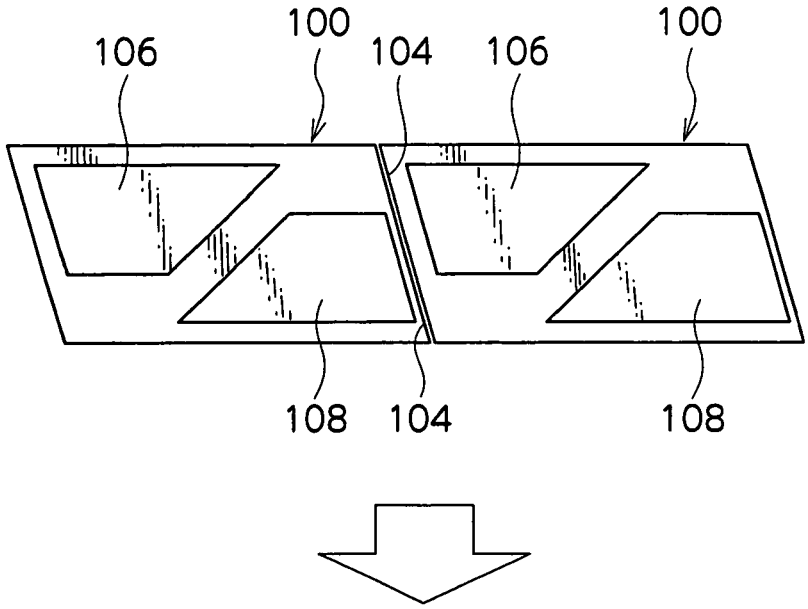
FIGS. 6A and 6B are plan views of head units constituting comparative examples for explaining the function of the head unit shown in FIG. 5.

On the other hand, in FIG. 6A showing a comparative structure, two element substrates 106, 108 in each of plural head units 100 are positioned with longer oblique sides of a substantially trapezoidal shape in a alternately opposed relationship. An inner angle of the substantially trapezoidal shape of the element substrates 106, 108 becomes smaller than an outer angle. In such case, the element substrates 106, 108 in the adjacent head units 100 cannot have a large overlapping amount when seen in the transporting direction of the recording medium P, whereby a space between the two becomes smaller and sufficient capping margin cannot be secured.

Figure 6B:
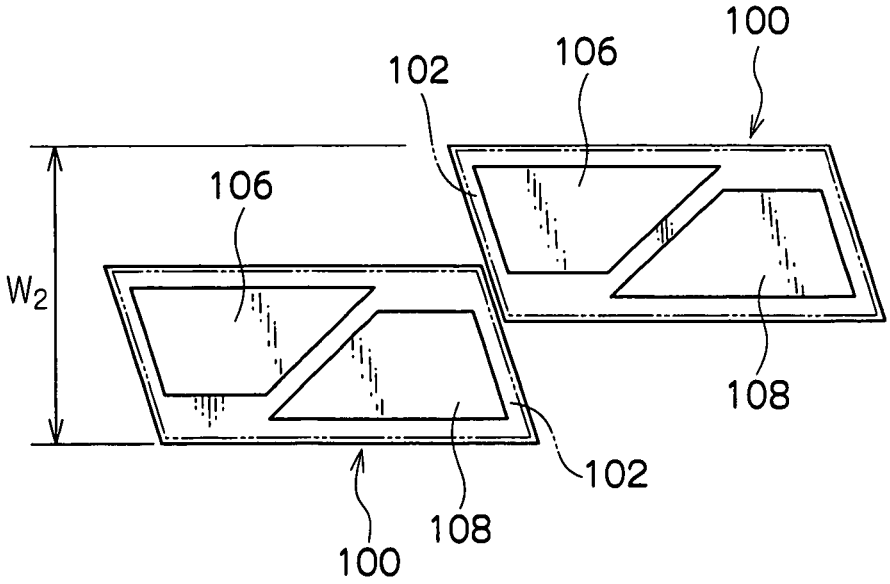

Also in cases where the adjacent head units 100 are alternately shifted as shown in FIG. 6B in order to secure a capping margin, the width $W_2$ of the head units becomes inevitably large. Also in the configuration shown in FIG. 6A, as a connecting portion 104 is formed shorter between the adjacent head units 100, such connecting portion 104 tends to clearly show a difference in the characteristics of the adjacent head units 100 and streaks or the like tend to become conspicuous on the image at the connecting portion 104.

In the following, a second embodiment of the present invention will be described with reference to the accompanying drawings.

Figure 7A:
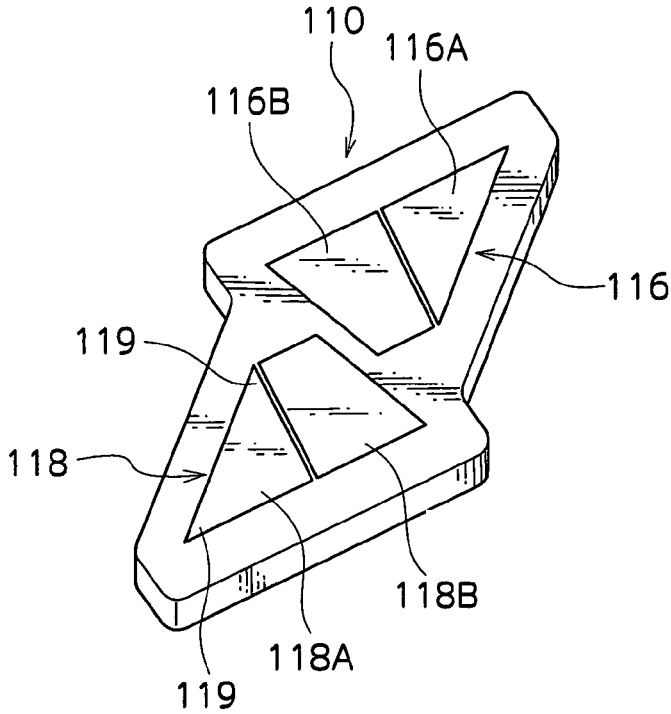
FIGS. 7A and 7B are respectively a perspective view of a head unit and a partial magnified view of an element substrate thereof, in an ink jet recording head of a second embodiment of the invention.
Figure 7B:
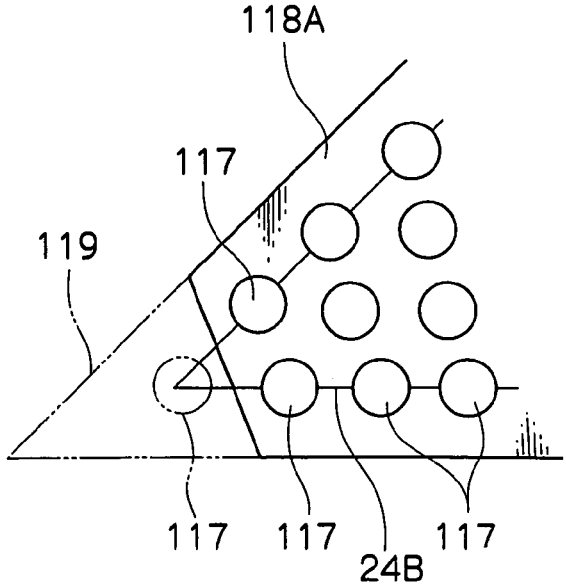

FIG. 7A is a perspective view showing a head unit 110 of an ink jet recording head of the second embodiment according to the present invention, and FIG. 7B is a view showing an element substrate of the head unit 110. Members similar to those in the first embodiment will be represented by corresponding symbols and will not be explained in repetition.

In the head unit 110, as shown in FIG. 7A, an element substrate 116 of a substantially trapezoidal shape is formed by combining an element substrate 116A of a substantially triangular shape and an element substrate 116B of a substantially trapezoidal shape in an adjacent position. An element substrate 118 of a substantially trapezoidal shape is formed by combining an element substrate 118A of a substantially triangular shape and an element substrate 118B of a substantially trapezoidal shape in an adjacent position. The configuration employing two element substrates 116A, 116B and two element substrates 118A, 118B allows to reduce production cost and to achieve an improvement of the production yield.

Also as shown in FIG. 7B, the element substrate 118A has two acute angle portions 119 of a substantially triangular shape, and may assume a shape in which such acute angle portions 119 are cut off. Two piezoelectric elements 117 are positioned in the portions where the acute angle portions 119 are cut off. The element substrate 118A is formed by cutting off the acute angle portions 119 since such acute angle portions 119 are easily chipped in the manufacture process, and the piezoelectric elements 117 are not provided in such cut-off portions. In this manner it is possible to reduce the influence by a chipping of the acute angle portions 119 in the element substrate 118A. The element substrate 116A may also be constructed in a similar manner.

Figure 8:
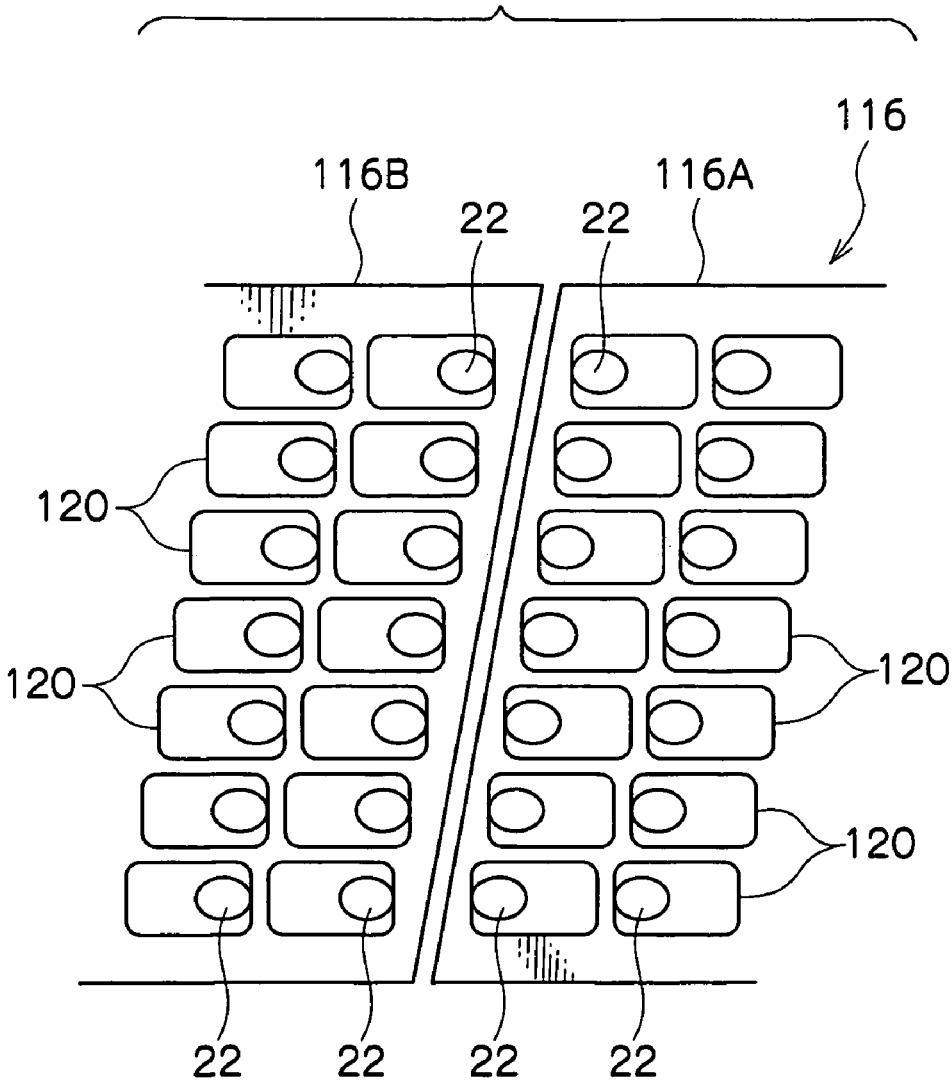
FIG. 8 is a partial magnified view of the head unit shown in FIG. 7A, illustrating an element substrate, a pressure chamber and a nozzle on the same plane.

FIG. 8 is a view showing element substrates, pressure chambers and nozzles in one plane, in an adjacent part of the element substrates 116A, 116B in the head unit 110.

In such head unit 110, a nozzle 22 is formed at an end side of a pressure chamber 120, and a direction of the pressure chamber 120 to the nozzle 22 is opposite across a connecting (boundary) gap between the element substrates 116A and 116B. Such configuration allows to arrange the pressure chambers 120 efficiently, when the nozzles 22 are uniformly arranged over the connecting gap between the element substrates 116A and 116B.

In the following, a third embodiment of the present invention will be described with reference to the accompanying drawings.

Figure 9:
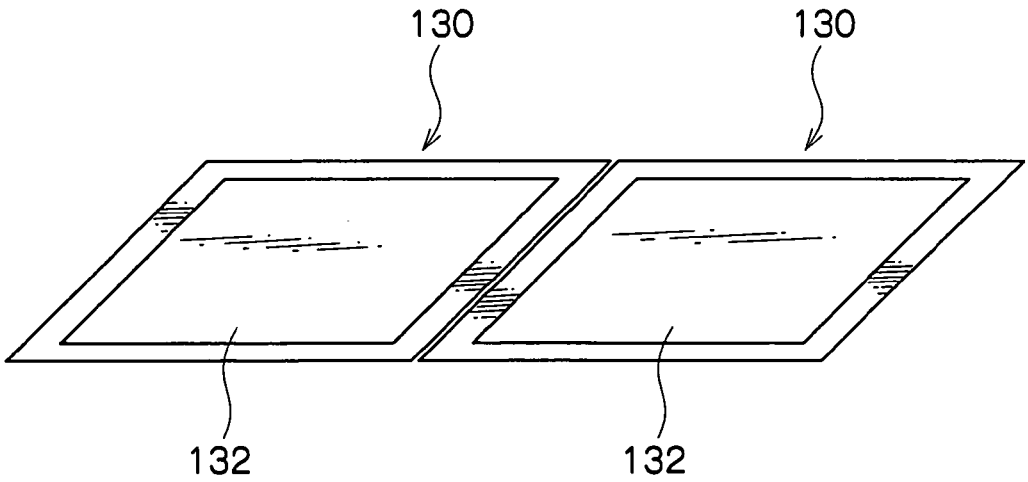
FIG. 9 is a plan view showing a head unit constituting an ink jet recording head of a third embodiment of the invention.

FIG. 9 is a plan view showing a head unit 130 of an ink jet recording head of the third embodiment of the present invention. Members similar to those in the first embodiment will be represented by corresponding symbols and will not be explained in repetition.

The head unit 130 has a substantially parallelogram shape, and such head units 130 are connected in a row in the transversal direction of the recording medium thereby constituting a head bar (not shown). Within the head unit 130, there is provided a single element substrate 132 of a substantially parallelogram shape. Such configuration allows to arrange the element substrate 132 efficiently and to reduce the width (width in the transporting direction of the recording medium) of the head unit 130.

Figure 10:
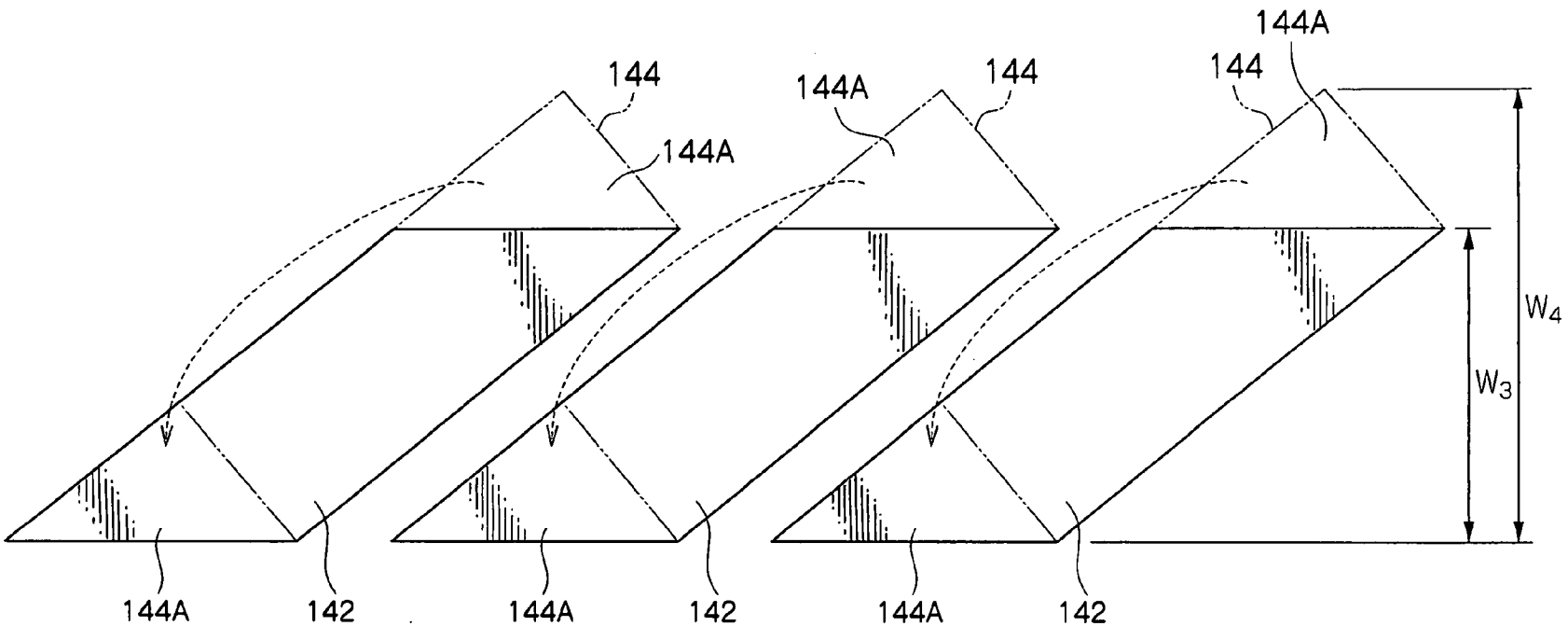
FIG. 10 is a view showing head units for explaining the function of the third embodiment of the invention.
Figure 11:
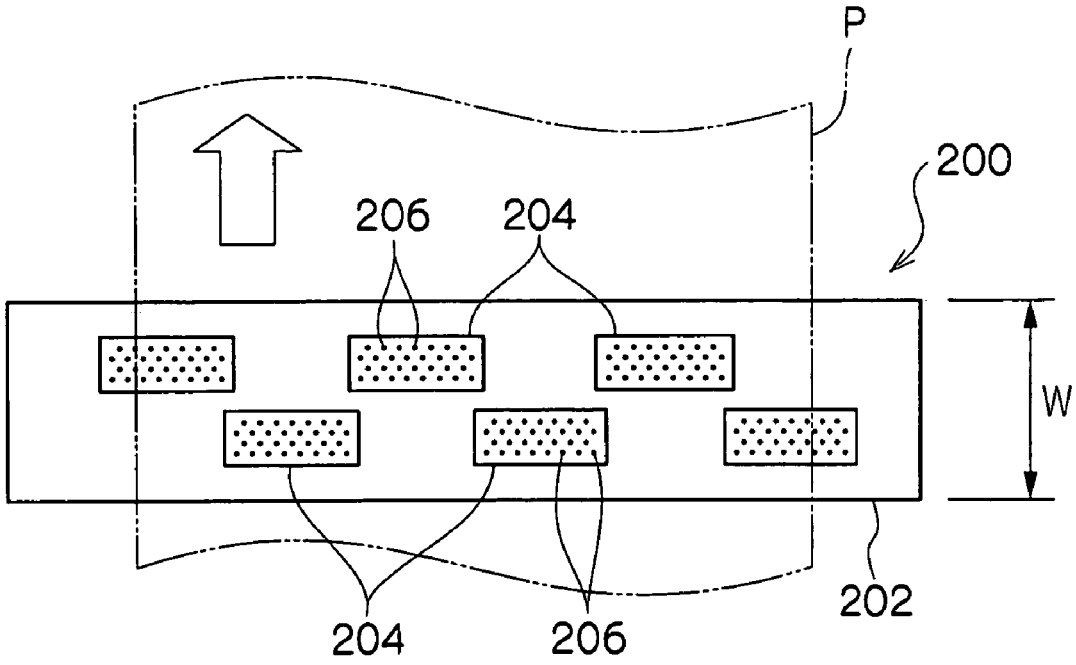
FIG.11 RELATED ART
FIG. 11 is a plan view showing an example of an ink jet recording head of the related art.
Figure 12:
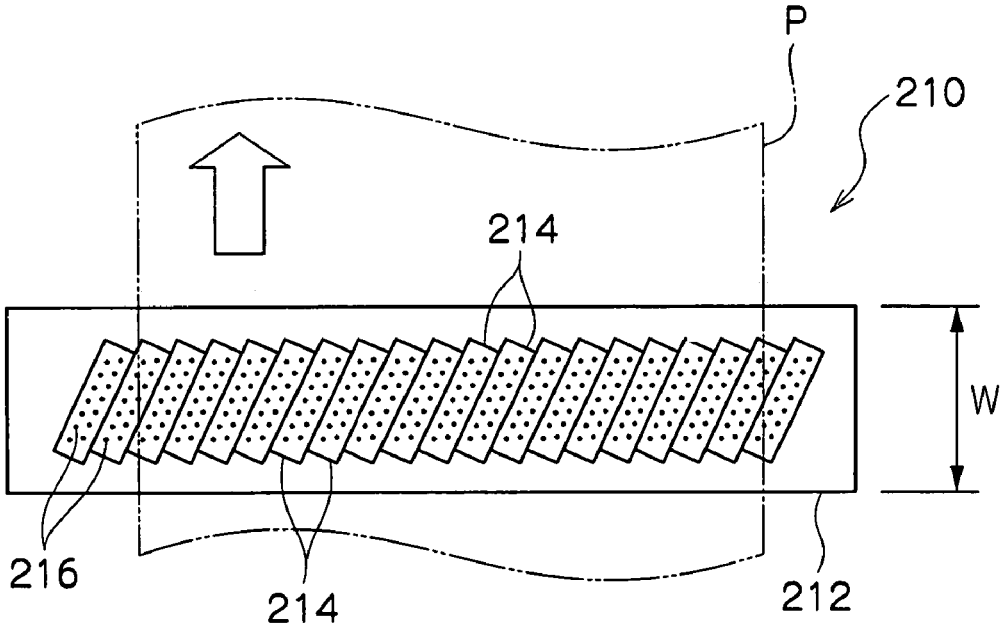
FIG.12 RELATED ART
FIG. 12 is a plan view showing another example of an ink jet recording head of the related art.

As shown in FIG. 10, in cases of forming element substrates 144 in a rectangular shape and arranging such element substrates mutually substantially parallel and obliquely to a longitudinal direction of a head bar (not shown), a resulting head unit has an increased width $W_4$. In contrast, by forming an element substrate 142 into a substantially parallelogram shape, it is possible to shift a substantially triangular portion 144A of the element substrate 144 to an end portion, as indicated by an arrow, of the element substrate 142. Stated differently, the element substrate 142 formed as a substantially parallelogram shape allows to reduce the width $W_3$ of the head unit, thereby achieving a compact structure.

The foregoing embodiments employ the element substrates 16, 18 of a substantially trapezoidal shape, but such shape is not restrictive and there can also be employed a substantially triangular shape. Also the element substrates 16, 18 may have a substantially trapezoidal shape of which corners are cut off or rounded.

Also in the foregoing embodiment, each head unit 14 includes two element substrates 16, 18, but such configuration is not restrictive and there may be provided element substrates of an even number such as 4 or 6. The element substrates of an even number allow an efficient arrangement within the head unit of a substantially parallelogram shape.

The ink jet recording head explained in the foregoing embodiments is intended to record an image (including a character) on a recording medium P, but such configuration is not restrictive. More specifically, the recording medium is not limited to paper, and the liquid to be discharged is not limited to an ink. There are included all liquid droplet emitting apparatuses utilized for industrial applications, such as discharging an ink onto a polymer film or a glass for preparing a color filter for a display, or discharging fused solder onto a board for forming a bump for component mounting.

In the ink jet recording head of the invention, the head bar may be formed in a size corresponding to a width of a recording medium.

Such ink jet recording head, having the head bar formed with the size corresponding to the width of the recording medium, is capable of printing across the entire width of the recording medium by passing the recording medium only once.

The head unit may include the element substrates of a substantially trapezoidal shape by an even number, and such element substrates of an even number may be arranged in such a manner that the substantially trapezoidal shapes are arrayed in an alternately mutually opposed arrangement.

The substantially parallelogram shape means to include a parallelogram of which corners are cut off or rounded.

In the aforementioned configuration, as the head unit includes the element substrates of a substantially trapezoidal shape by an even number and such substantially trapezoidal shapes are arrayed in an alternately mutually opposed arrangement, the element substrates can be efficiently arranged within the head unit of a substantially parallelogram shape. Element substrates of an odd number cannot be arranged efficiently in the head unit of a substantially parallelogram shape (because a parallelogram cannot be formed), whereby the head unit becomes larger in size. It is thus possible to achieve high resolution while reducing the width (in the transporting direction of the recording medium) of the head unit, thereby realizing a compact head bar.

The head unit may include two element substrates of a substantially trapezoidal shape, and the two element substrates may be arranged so that such substantially trapezoidal shapes are mutually opposed. In the trapezoidal shapes within the head unit, the oblique sides other than the mutually opposed oblique sides may be longer oblique sides.

In such configuration, since the head unit includes two element substrates of a substantially trapezoidal shape and, in the trapezoidal shapes within the head unit, the oblique sides other than the mutually opposed oblique sides are longer oblique sides, the element substrates can be efficiently arranged within the head unit of a substantially parallelogram shape. It is thus possible to achieve high resolution while reducing the width (in the transporting direction of the recording medium) of the head unit, thereby realizing a compact head bar.

In the element substrate, an inner angle formed by the oblique side in the mutually opposed position may be larger than an outer angle formed by an oblique side opposed to the aforementioned oblique side.

In such configuration, since the substantially trapezoidal shape of the element substrate has an outer angle smaller than an inner angle, there can be secured a large space between the adjacent element substrates when plural head units are connected in a row. As the element substrates of the adjacent head units have a large overlapping amount when seen in the transporting direction of the recording medium, the space becomes correspondingly large. It is therefore possible to secure a large capping margin for each head unit at the maintenance operation, and also to improve the productivity. Also, when plural head units are connected, the adjacent head units have a long connecting portion, so that the difference in the characteristics between the head units at the connecting portion becomes less conspicuous and streaks or the like do not appear at the printing.

Also the element substrate of the substantially trapezoidal shape may be constituted by connecting, in a close relationship, a first element substrate of a substantially triangular shape and a second element substrate of a substantially trapezoidal shape or a substantially parallelogram shape.

The substantially triangular shape means to include a triangle of which corners are cut off or rounded.

In such configuration, as the element substrate of the substantially trapezoidal shape is constituted by connecting, in a close relationship, a first element substrate of a substantially triangular shape and a second element substrate of a substantially trapezoidal shape or a substantially parallelogram shape, there can be achieved cost reduction and an improvement in the production yield.

The element substrate may include two or more drive elements in an acute angle portion.

In such configuration, an acute angle portion of the element substrate, easily chipped at the manufacture, is provided with two or more drive elements. It is thus rendered possible to alleviate the influence of a chipping of the acute angle portion, by not forming an acute angle portion having only one drive element.

Also in the head unit, the drive element is so driven as to cause a pressure wave to act on an ink in a pressure chamber thereby discharging an ink droplet from a nozzle, and the directions of the pressure chambers with respect to the nozzles may be made mutually opposite across a connecting portion of the first element substrate and the second element substrate in a close relationship.

In such configuration, since the directions of the pressure chambers with respect to the nozzles are made mutually opposite across the connecting portion of the first element substrate and the second element substrate in a close relationship, the plural nozzles can be arranged with a uniform pitch, even in case a gap is formed in the connecting portion of the first element substrate and the second element substrate, whereby the element substrates can be arranged more easily.

Also the drive element is preferably a piezoelectric element.

In such configuration where the drive element is a piezoelectric element, by driving such piezoelectric element, a pressure wave can be made to act on the ink in the pressure chamber, thereby discharging an ink droplet from the nozzle.

Also it is preferred that the head unit includes extended portions formed by outward extending of two obtuse angle portions of the substantial parallelogram and corner cut portions formed by cutting off two acute angle portions and that, when plural head units are connected in a row, the extended portion and the corner cut portion in adjacent positions are in a mutually opposed relationship.

In such configuration, the head unit includes extended portions formed by outward extending of two obtuse angle portions of the substantial parallelogram and corner cut portions to be opposed to the extended portions when the head units are connected in a row. Such configuration prevents a decrease in the distance between the element substrate of the substantially trapezoidal shape and the edge of the head unit even when the head unit is formed in a substantially parallelogram shape, and eliminates the influence of a chipping because there are no acute angle portions provided.

Also the head unit may be detachably mounted on a support member of a length corresponding to the width of the recording medium.

In such configuration, since the head unit is detachably mounted on the support member, a replacement on the basis of individual head units is possible at the maintenance operation and a replacement of the whole head bar is not required.

What is claimed is:

1. An ink jet recording head comprising:

a head bar formed by a plurality of adjacently disposed and independently connected head units forming a row, each head unit including piezoelectric elements, nozzles, and pressure chambers; and an element substrate provided in each of the plurality of head units and constituted of a plurality of drive elements, wherein each of the plurality of head units has a substantially non-rectangular parallelogram shape including two obtuse angle portions that extend outward to form extended portions and two acute angle portions that are cut off to form corner cut portions, and the element substrate is driven so as to discharge ink droplets from a plurality of nozzles.

2. An ink jet recording head according to claim 1, wherein the head bar is formed with a length dimension corresponding to a width of a recording medium.

3. An ink jet recording head according to claim 2, wherein the head bar has a printable area across an entire width of the recording medium.

4. An ink jet recording head according to claim 1, wherein each of the plurality of head units includes an even number of the element substrates, the element substrates have a substantially trapezoidal shape, and the even number of the element substrates are arranged so that the substantially trapezoidal shapes are arrayed in alternately opposed positions.

5. An ink jet recording head according to claim 4, wherein each of the element substrates has an inner angle formed by an oblique side in an alternately opposed position that is larger than an outer angle formed by another oblique side.

6. An ink jet recording head according to claim 4, wherein each of the element substrates of the substantially trapezoidal shape includes a first element substrate of a substantially triangular shape and a second element substrate of any one of a substantially trapezoidal shape and a substantially parallelogram shape, and is constituted by connecting the first and second element substrates to each other in an adjacent position.

7. An ink jet recording head according to claim 6, wherein each of the plurality of head units is adapted to drive the drive elements thereby causing a pressure wave to act on an ink in a pressure chamber to discharge ink droplets from the plurality of nozzles, and directions of the pressure chambers with respect to the plurality of nozzles are made mutually opposite across a boundary between portions of the first element substrate and the second element substrate that are connected to each other in the adjacent position.

8. An ink jet recording head according to claim 4, wherein each of the element substrates has two or more drive elements in an acute angle portion thereof.

9. An ink jet recording head according to claim 8, wherein each of the element substrates has a shape which is cut off in the vicinity of an apex of an acute angle portion.

10. An ink jet recording head according to claim 1, wherein each of the plurality of head units includes two element substrates of a substantially trapezoidal shape, the two element substrates are arranged so that the substantially trapezoidal shapes are arranged in alternately opposed positions, and in the trapezoidal shapes in each of the plurality of head units, oblique sides other than alternately opposed oblique sides are longer than the alternately opposed oblique sides.

11. An ink jet recording head according to claim 1, wherein at least one of the plurality of drive elements is a piezoelectric element.

12. An ink jet recording head according to claim 1, wherein each of the plurality of head units includes extended portions formed by extending outward two obtuse angle portions of the substantially parallelogram shape and corner cut portions formed by cutting off two acute angle portions of the substantially parallelogram shape, and when the plurality of head units are connected in a row, the extended portions and the corner cut portions are alternately opposed in adjacent positions.

13. An ink jet recording head according to claim 1, wherein each of the plurality of head units is detachably mounted on a support member of a length corresponding to a width of a recording medium.

14. An ink jet recording head comprising:

a head bar formed by connecting a plurality of head units in a row and having a length dimension corresponding to a width of a recording medium, each head unit including piezoelectric elements, nozzles, and pressure chambers; and two element substrates provided in each of the plurality of head units, each of the two element substrates being constituted of a plurality of drive elements, wherein each of the plurality of head units has a substantially non-rectangular parallelogram shape including two obtuse angle portions that extend outward to form extended portions and two acute angle portions that are cut off to form corner cut portions, each of the two element substrates have a substantially trapezoidal shape, the two element substrates are arranged so that the substantially trapezoidal shapes are arrayed in alternately opposed positions, in the trapezoidal shapes in each of the plurality of head units, oblique sides other than alternately opposed oblique sides are longer than the alternately opposed oblique sides, and the two element substrates are driven so as to discharge ink droplets from a plurality of nozzles.

15. An ink jet recording head according to claim 14, wherein each of the two element substrates of the substantially trapezoidal shape includes a first element substrate of a substantially triangular shape and a second element substrate of any one of a substantially trapezoidal shape and a substantially parallelogram shape, and each of the two element substrates of the substantially trapezoidal shape is constituted by connecting the first and second element substrates to each other in an adjacent position.

16. An ink jet recording head according to claim 14, wherein each of the two element substrates has two or more drive elements in an acute angle portion thereof.

17. An ink jet recording head according to claim 16, wherein each of the two element substrates has a shape which is cut off in the vicinity of an apex of an acute angle portion.

18. An ink jet recording head according to claim 14, wherein at least one of the plurality of drive elements is a piezoelectric element.

19. An ink jet recording head according to claim 14, wherein each of the plurality of head units includes extended portions formed by extending outward two obtuse angle portions of the substantially parallelogram shape and corner cut portions formed by cutting off two acute angle portions of the substantially parallelogram shape, and when the plurality of head units are connected in a row, the extended portions and the corner cut portions are alternately opposed in adjacent positions.

20. An ink jet recording head according to claim 14, wherein each of the plurality of head units is detachably mounted on a support member of a length corresponding to the width of the recording medium.

21. An ink jet recording apparatus mounted with an ink jet recording head, wherein the ink jet recording head includes a head bar formed by connecting a plurality of head units in a row, each head unit includes piezoelectric elements, nozzles, and pressure chambers, and an element substrate is provided in each of the plurality of head units, the element substrate being constituted of a plurality of drive elements, each of the plurality of head units has a substantially non-rectangular parallelogram shape including two obtuse angle portions that extend outward to form extended portions and two acute angle portions that are cut off to form corner cut portions, and the element substrate is driven so as to discharge ink droplets from a plurality of nozzles.

22. An ink jet recording apparatus according to claim 21, wherein each of the plurality of head units includes an even number of the element substrates, the element substrates have a substantially trapezoidal shape, and the even number of the element substrates are arranged so that the substantially trapezoidal shapes are arranged in alternately opposed positions.

* * * * *